US005589313A

United States Patent [19]

Takezawa et al.

[11] Patent Number: 5,589,313

[45] Date of Patent: Dec. 31, 1996

[54] METHOD FOR NONMAGNETIC MONOCOMPONENT DEVELOPMENT

[75] Inventors: Satoshi Takezawa; Yoshimichi Katagiri; Yasushige Nakamura; Norio Sawatari, all of Kawasaki, Japan

[73] Assignee: Fujitsu, Ltd., Kawasaki, Japan

[21] Appl. No.: 605,838

[22] Filed: Feb. 22, 1996

Related U.S. Application Data

[63] Continuation of Ser. No. 177,192, Jan. 3, 1994, abandoned, which is a continuation of Ser. No. 965,362, filed as PCT/JP92/00491, Apr. 17, 1992, published as WO92/18909, Oct. 29, 1992, abandoned.

[30] Foreign Application Priority Data

Apr. 19, 1991 [JP] Japan ..... 3-088548

[51] Int. Cl.[6] ..... G03G 9/08

[52] U.S. Cl. ..... 430/122; 430/108; 430/111; 430/120; 430/137

[58] Field of Search ..... 430/122, 108, 430/111, 120, 137

[56] References Cited

U.S. PATENT DOCUMENTS

| | | | |
|---|---|---|---|
| 4,777,904 | 10/1988 | Gundlach et al. | 118/653 |
| 4,923,777 | 5/1990 | Imai et al. | 430/120 |
| 5,182,181 | 1/1993 | Koizumi et al. | 430/111 |
| 5,215,845 | 6/1993 | Yusa et al. | 430/122 |

FOREIGN PATENT DOCUMENTS

| | | |
|---|---|---|
| 0078077 | 5/1983 | European Pat. Off. . |
| 0291296 | 11/1988 | European Pat. Off. . |
| 0302939 | 2/1989 | European Pat. Off. . |
| 0357376 | 3/1990 | European Pat. Off. . |
| 59-95542 | 6/1984 | Japan . |
| 61-130962 | 6/1986 | Japan . |
| 63-205665 | 8/1988 | Japan . |
| 1-101557 | 4/1989 | Japan . |

*Primary Examiner*—S. Rosasco
*Attorney, Agent, or Firm*—Staas & Halsey

[57] ABSTRACT

A method for nonmagnetic monocomponent development is intended for use in an electrophotographic copying machine or electrophotographic printer and is capable of producing highly durable prints of high quality during continuous printing operations. In the nonmagnetic monocomponent development, a developer is transported by a development roller to a photoconductor drum. A Doctor blade triboelectrifies the developer and simultaneously regulates the thickness of a layer of the developer. As the developer, a toner is used, which toner is produced by coagulating minute particles having a diameter between 0.1 and 3.0 μm and then heating the minute particles, thereby thermally fusing these particles.

26 Claims, 3 Drawing Sheets

METHOD FOR NONMAGNETIC MONOCOMPONENT DEVELOPMENT

This application is a continuation of application Ser. No. 08/177,192, filed Jan. 3, 1994, now abandoned, which is a continuation of application Ser. No. 07/965,362, filed as PCT/JP92/00491, Apr. 17, 1992, published as WO92/18909, Oct. 29, 1992, now abandoned.

BACKGROUND OF THE INVENTION

1. Field of the Invention

This invention relates to a method for the development of an image in a copying machine or printer such as an electrophotographic copying machine, an electrophotographic printer, or an electrographic recording device by using a nonmagnetic monocomponent developer. More particularly, this invention relates to a method for development that encounters no toner fracture under the impact of a Doctor blade, enjoys satisfactory drum cleanability, does not sacrifice printing properties even during continuous printing operations, and ensures ideal print quality.

2. Description of the Related Art

As an electrophotographic process, the method disclosed as in U.S. Pat. No. 2,297,691 has been widely known in the art. This method generally produces a print by imparting a uniform electrostatic charge to a photoconducting insulator (such as, for example, a sensitive drum) by means of corona discharge, projecting an optical image on the photoconducting insulator by various means thereby forming an electrostatic latent image thereon, then developing the latent image into a visible image by using a fine powder called a toner, transferring the toner image, when necessary, onto a sheet of paper, and fusing the toner image by applying pressure, heat, vapor of solvent, or light, thereby fixing the fused toner image on the paper. As the toner for developing this electrostatic latent image, the particles obtained by dispersing a coloring agent, such as a dye or carbon black in a binder resin formed of a natural or synthetic polymer resin, and pulverizing the resultant dispersed mixture to a particle size on the order of 1 to 30 μm, have been used to date. These particles are called pulverized toner.

The toner of this sort is generally used either by itself or in combination with a carrier such as glass beads for the development of the electrostatic latent image.

When the toner is used in its simple form for development (method of monocomponent development), this toner is deposited on a development roller and electrically charged by a Doctor blade. The toner is then transported to the latent image part on the photoconductor by the rotation of the development roller and development of the latent image is attained because the electrically charged toner is exclusively attached to the latent image by the force of electrical attraction.

In the conventional method of nonmagnetic monocomponent development, the amount of toner to be deposited on the development roller is regulated by means of the Doctor blade; a roller made of a metallic substance or hard rubber is used as the development roller, and a pulverized toner formed of a resin such as styrene-acryl is used as the toner.

This method involves the problem of insufficient electrical charging and inferior print quality because the toner particles are crushed under the impact of the Doctor blade in the course of continued printing, suffers from a consequent increase in the proportion of small particles content, sacrifices flowability of a consequence of the entry of finely crushed toner particles into the interstices between the toner particles of the standard particle diameter, and is susceptible to degradation of the efficiency of contact between the toner and the Doctor blade.

Further, the finely crushed toner particles exhibit poor cleanability and tend to escape contacting the cleaner blade and, with the toner's low capacity for electrical charging and the increase of the amount of untransferred toner as contributory factors, tend to accumulate on the surface of the photoconductor drum possibly to the extent of interfering with the formation of the latent image and thereby contributing to the degradation of print quality.

The occurrence of the finely crushed toner particles may be attributable to the fact that the method of nonmagnetic monocomponent development exposes the toner to immense stress "when the toner is electrically charged by contacting the metallic blade on the roller made of a metallic substance or hard rubber" and the fact that the toner particles obtained by the technique of pulverization inevitably have sharp corners and, therefore, tend to sustain fractures along such sharp corners.

In contrast, suspended polymerization toner particles shaped like true spheres defy fracture, but, they entail the problem of readily assuming the most densely packed state and sacrifice flowability, have poor charging properties, roll readily on a surface and consequently tend to escape contacting the cleaner blade of the photoconductor drum, and suffer from inferior cleanability.

SUMMARY OF THE INVENTION

This invention, arising out of the problems entailed by the prior art as described above, aims to provide a method for nonmagnetic monocomponent development that excels in resistance to fracture, charging properties, and cleanability, retains printing properties even in the course of continued printing, possesses the ability to produce highly durable prints of ideal quality, and defies alterations in printed images.

To be specific, this invention consists in a method for nonmagnetic monocomponent development using a toner that offers high resistance to fracture, avoids inducing a change in particle size distribution, enjoys ideal flowability as used in its simple form, and finds utility as a toner in simple form in the development; the method of which allows the toner to sufficiently contact the Doctor blade and consequently to manifest ideal charging properties, exhibits the ability to be cleaned completely with a cleaner blade even on the photoconductor drum, and succumbs to thorough charging without sustaining any undue stress.

The method for nonmagnetic monocomponent development is required to possess these characteristics; (1) that the toner should not be fractured by pressure exerted by the Doctor blade, (2) that the toner in its simple form should exhibit high flowability and should be amply charged by the layer thickness-regulating blade, and (3) that the photoconductor drum smeared with the toner should be thoroughly cleaned with the cleaner blade.

As measures to fulfill these characteristics, the following conditions are appropriate; (1) the toner should offer due resistance to fracture and abrasion and not possess numerous sharp corners, (2) the development roller and the Doctor blade should be made of elastic substances for the purpose of reducing the stress exerted on the toner, (3) the toner particles should have an irregular shape and a duly large diameter so that the toner excels in flowability and charging properties and, when used in its simple form for the development, will avoid assuming the most densely packed state, and (4) the toner particles should be in an irregular shape sufficient to be easily picked up on the cleaner blade so that the photoconductor drum smeared with the toner will be cleaned completely. Among other measures mentioned above, the measure involving the use of a Doctor blade of an elastic material is devoid of practicability because the blade is prone to abrasion. The Doctor blade is kept under an applied voltage. The toner, therefore, is electrically charged by the friction thereof with the Doctor blade and the exertion of the electric charge. Thus, the material for the Doctor blade is limited to a metal possessing high electroconductivity.

To fulfill the characteristics mentioned above, the present inventors have perfected a method for nonmagnetic monocomponent development using a Doctor blade capable of triboelectrifying the developer and, at the same time, regulating the thickness of the layer of the developer; the method of which is characterized in (1) that the toner used therefore is an emulsion polymerization toner obtained by coagulating very minute particles formed by the emulsion polymerization technique and fusing these minute particles along their interfaces, (2) that the surface of fusion between the adjacent minute particles is enlarged and the toner's resistance to fracture is improved by controlling the time to be spent for the fusion of the minute particles along their interfaces, (3) that the toner is vested with a suitable irregular shape by providing the toner a BET specific surface area of not less than 1.76 $m^2/g$ and not more than 4.50 $m^2/g$, and (4) that the toner particles are given diameters falling in the range between 5.0 and 10.5 μm.

For the sake of this invention, the development roller is preferably made of a soft electroconductive elastomer having an Ascar C hardness not more than 50°. This development roller preferably possesses a porous texture.

DETAILED DESCRIPTION OF THE PREFERRED EMBODIMENT

Figure 1:
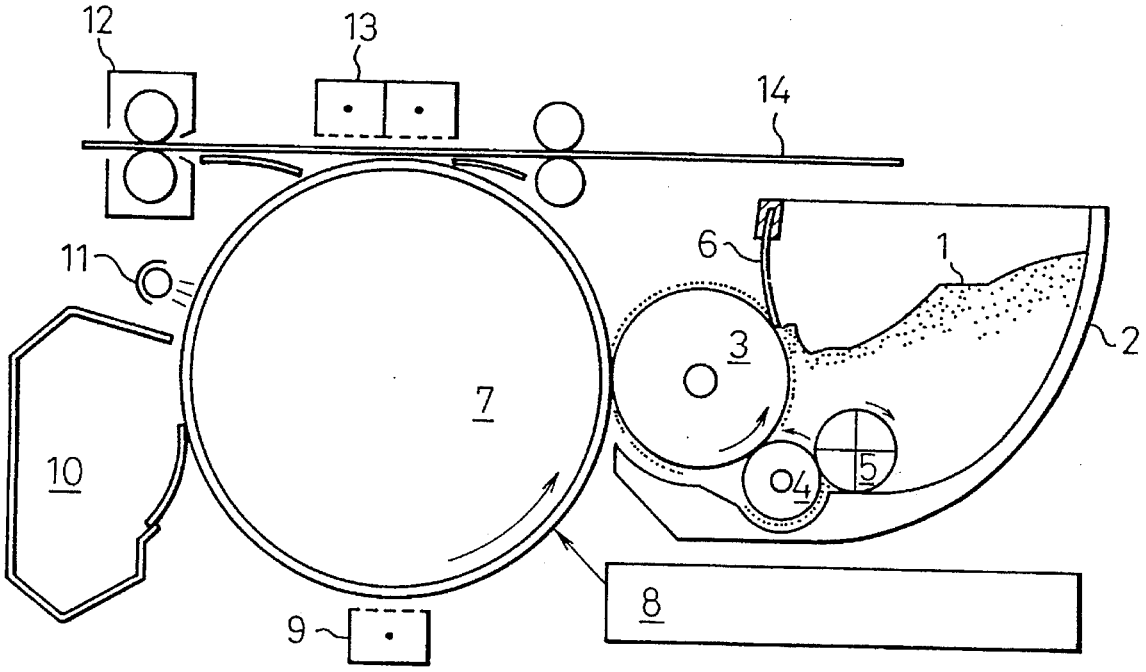
FIG. 1 is a diagram illustrating one example of the construction of an electrographic recording apparatus to be used with the method of this invention.

Now, the best mode of embodying this invention will be described below.

First, adoption of the technique of emulsion polymerization for the manufacture of a toner allows production of toner particles devoid of sharp corners and, therefore, capable of precluding possible fractures occurring along such sharp corners.

The toner, when given a particle diameter of not less than 5.0 μm and a BET value of not less than 1.76 $m^2/g$, is then allowed to acquire a limited irregular shape, an extremely small particle diameter, and cleanability not easily attained with the conventional toner particles having the shape of true spheres. This cleanability may be ascribed to the fact that, in spite of their relatively small diameter, the toner particles are capable of being readily picked up by the cleaner blade of the drum because of their amorphous form. In the existing state, if the particle diameter of the toner is not more than 5.0 μm, the cleanability of the toner on the drum is short of being satisfactory in spite of the amorphous form. The particle diameter not less than 5.0 μm and the BET value not less than 1.76 $m^2/g$ are the magnitudes that are defined exclusively in the light of cleanability. When the process of toner production itself is improved in the future as to enhance cleanability, the toner having a particle diameter of not more than 5.0 μm and a BET value of not more than 1.76 $m^2/g$ may be rendered adaptable for this invention. In due respect of the cleanability that is attainable by the existing process, the particle diameter is defined to be not less than 5.0 μm and the BET value to be not less than 1.76 $m^2/g$.

The fact that the BET value is defined to be not more than 4.50 $m^2/g$ eliminates the problem of toner fracture from continued printing by enlarging the interface of fusion between the adjacent minute toner particles and consequently heightening the strength of fusion. If the BET value exceeds 4.50 $m^2/g$ and the interface of fusion between the adjacent toner particles is small, the toner succumbs to fracture and the finely crushed toner particles lower the amount of toner charging and jeopardize drum cleanability.

The technique of emulsion polymerization is capable of coagulating very minute polymer particles and growing them to the toner particle diameter. If the particle diameter of the toner exceeds 10.5 μm, the number of individual minute particles required to form one piece of toner is large and the total interface of fusion between the minute particles existing within one piece of toner is proportionately large to aggravate the possibility of the toner sustaining fractures at the site of an enlarged fusion interface.

Further, as concerns the fracture of toner particles, the stress to be exerted on the toner is reduced as a result of the construction of the apparatus, specifically by forming the development roller with an electroconductive elastomer having an Ascar C hardness of not more than 50°. Further, the fact that the development roller possesses a porous texture enhances the transportability of the toner and ensures the flowability of the developer formed of a toner having a relatively small diameter. The fact that the development roller is formed in a single layer decreases the number of treatment steps during the process of manufacturing and improves the performance and reliability of the produced development roller.

The monomer to be used in this invention naturally is not limited to styrene-acryl. It is required only to possess one ethylenically unsaturated bond in the molecular unit thereof. The monomers that fulfill this requirement include styrene and derivatives thereof such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-nonylstyrene, p-n-octylstyrene, p-n-hexylstyrene, and p-n-dodecylstyrene; ethylenically unsaturated monoolefins such as ethylene, propylene, butylene, and isobutylene; halogenated vinyls such as vinyl chloride, vinylidene chloride, vinyl bromide, and vinyl fluoride; vinyl esters such as vinyl acetate, vinyl propionate, and vinyl benzoylate; α-methylene fatty acid monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethyl aminoethyl methacrylate, and diethyl aminoethyl methacrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; n-vinyl compounds such as N-vinyl pyrrole, N-vinyl corbazale, N-vinyl indole, and N-vinyl pyrrolidine; vinyl naphthalenes; and acrylic acid or methacrylic acid derivatives such as acrylonitrile, methacrylonitrile, and acrylamide, for example. These monomers may be used either alone or in the form of a mixture of two or more members.

As the emulsifier for the emulsion polymerization, any of the known emulsifiers such as, for example, soap, cationic surfactants, anionic surfactants, and fluorine type surfactants can be used. Generally, the amount of such emulsifier to be used is preferably in the range between 0.01 and 1% by weight, preferably between 0.1 and 0.5% by weight, based on the amount of water.

Then, as the polymerization initiator, any of the known water-soluble polymerization initiators such as, for example, potassium persulfate, ammonium persulfate, and other persulfates, and hydrogen peroxide may be favorably used. Generally, the amount of such polymerization initiator is sufficient in the range between about 0.01% and about 10%, preferably between 0.05% and 5% by weight, based on the weight of the polymer mixture.

As the coloring agent, any of the known pigments and dyes can be used. Examples of a black pigment are channel black and furnace black.

The components for the raw material of the toner, when necessary, may incorporate therein such additives as a charge control agent and a flowability-improving agent, for example.

The method to be adopted for the emulsion polymerization of the monomer mixture is described in detail in Japanese Unexamined Patent Publications No. 281,172/1988 and No. 282,749/1988, for example. Briefly, this method comprises first adding the monomer mixture to water already containing an emulsifier, dispersing and emulsifying the resultant mixture with a disperser or ultrasonic homogenizer, and stirring and heating the mixture to effect radical polymerization. This radical polymerization is carried out at a temperature exceeding 50° C., and generally falling in the range between 70° C. and 90° C. The radical polymerization system is consequently formed and a coloring agent such as carbon and a charge-control agent added thereto are continuously heated to effect coagulation of minute emulsion particles. This process step gives rise to minute particles having an average particle diameter in the range between 0.1 and 3 μm. Then, the liquid in which the produced polymer is dispersed is stirred and a salting-out agent is added thereto to induce coagulation of the minute particles. The resultant mixture is continuously stirred and further heated [to a temperature exceeding the Tg point of the resin (generally in the neighborhood of 100° C.)], to obtain a toner in which the minute component particles are fused.

The particle diameter of the toner can be controlled by the condition of salting-out and the form of the toner and the strength of fusion between the adjacent minute toner particles can be controlled by varying the heating time (the increase in the strength of fusion between the adjacent minute particles enlarges the area of fusion between the adjacent minute particles and allows the toner particles to approximate spheres).

After the thermal fusion of the minute particles has been completed, the product is washed and recovered using a suitable method such as filtration or decantation, to obtain the emulsion polymerization toner.

After a diligent study, the present inventors have perfected a method for nonmagnetic monocomponent development which, owing to the use of an emulsion polymer toner having a particle diameter in the range between 5.0 and 10.5 μm and a BET specific surface area of not less than 1.76 $m^2/g$ and not more than 4.50 $m^2/g$ and a development roller made of a soft electroconductive elastomer having an Ascar C hardness not more than 50°, enables the toner to defy fracture due to the impact of the Doctor blade, exhibit ideal electroconductivity, confer cleanability on the photoconductor drum, and continue to produce highly durable prints of high quality even during the course of continued printing.

Now, this invention will be described more specifically below with reference to working examples. Of course, this invention is not limited to these working examples.

EXAMPLES

First, the electrographic recording apparatus to be used in the method for nonmagnetic monocomponent development of this invention will be described below.

FIG. 1 represents an example of the construction of the apparatus (apparatus example 1). In this invention, a toner 1 is interposed between storing means 2 and a development roller 3, formed of a porous electroconductive elastomer and adapted to convey the toner along a prescribed circulation path including a developing area. Reset roller 4 of the shape of a roller having the surface part thereof coated with a plasticizer, is disposed in such a manner as to contact the development roller 3 as illustrated in FIG. 1. A bias voltage for transferring the toner 1 from the development roller 3 to the reset roller 4 (hereinafter referred to as "reset bias") is applied between the development roller 3 and the reset roller 4. Thus, the development roller can be stably and infallibly deprived of mechanical and electrical hysteresis by the mechanical recovery relying on physical contact as well as by the electrical recovery resorting to the reset bias. Then, the toner 1 stored in the storing means 2 which is kept in contact with the development roller 3, is supplied to the development roller 3 by a toner supplying means 5. A Doctor blade 6 converts the supplied toner 1 into a toner layer of a desired thickness and, at the same time, electrically charges the layer. As a result, the charged toner layer is transported to the developing area and used therein for development.

A photoconductor drum 7 serves the purpose of allowing a latent image formed on the surface thereof to be transported to the developing part and then causing a developer image formed consequently thereon to be transported to the position at which the developer image is to be transferred onto a recording paper. The photoconductor drum 7, depending on the mode of formation of the latent image, may be made of a photoconductor material using a photoconducting substance (organic photoconductor material, selenium photoconductor material, or amorphous silicon photoconductor material, for example) or an insulating material.

The development roller 3 used in the present apparatus is formed of a porous electroconductive elastomer having pores measuring 3 to 20 μm in diameter so as to allow entry of toner particles measuring approximately 5 to 10 μm in diameter. It has been confirmed that even when the pores are opened and allowed to intercommunicate, the toner particles inside the pores support one another and avoid occluding the pores so long as these pores have diameters not exceeding 20 μm. When the pores have diameters exceeding 20 μm, the entry of toner particles into the pores can be precluded so long as the pores are produced in a closed form. In the depressed parts, the distance between the latent image and the conductor (porous texture itself in this case) is so large that the developing bias fails to apply to the toner in the particular parts and parts of low image density conforming to the depressed parts in the porous texture manifest themselves in a produced print. Thus, the pores in the development roller 3 preferably have diameters not exceeding 20 μm. The magnitude of volume resistance of the porous texture (sponge) is desired to be in the range between $10^4$ and $10^{10}$ Ωcm. If the electric resistance is unduly low, the charged member admits the flow of a large current and generates Joule heat and the development roller is damaged by burning. Conversely, if the electric resistance is unduly high, the potential difference between the surface of the carrier and the surface of the photoconductor drum increases so much as to induce the phenomenon of background fogging. The surface hardness of the development roller is set at 23° on the Ascar C scale.

In another example of the apparatus (apparatus example 2), the surface hardness of the development roller is set at 45° on the Ascar C scale.

Examples 1–3

Monomers [90 parts by weight of styrene (produced by Wako Junyaku), 10 parts by weight of butyl acrylate (produced by Wako Junyaku), and 5 parts by weight of n-butyl methacrylate (produced by Wako Junyaku)], Coloring agents [2 parts by weight of carbon black (150T, produced by Degussa) and 2 parts by weight of azochrome dye (S:34, produced by Orient K.K.)], Emulsifier [0.2 parts by weight of Neogen SC (produced by Daiichi Kogyo K.K.)], Thermal polymerization initiator [0.2 part by weight of potassium persulfate], Salting agent [0.05 parts by weight of an aqueous 10% sodium chloride solution], and Adjuvant [0.5 parts by weight of hydrophobic silica (H-2000, produced by Hoechst)].

A monomer composition was prepared by stirring the monomers mentioned above by using a disperser (produced by Yamato Kagaku K.K.) for three minutes. Then, in 500 parts by weight of distilled water containing the polymerization initiator and the emulsifier mentioned above, the monomer composition was placed and stirred by using a disperser (4,000 r.p.m.) at normal room temperature (20° C.) for three minutes. Subsequently, the resultant mixture was stirred with a three-one motor at 100 r.p.m. and simultaneously heated to 60° C. to effect thorough polymerization of the monomer composition. Then, the resultant dispersion containing emulsion particles and the coloring agents such as carbon added thereto were continuously heated to induce agglomeration of emulsion particles and give rise to minute particles measuring 0.1 to 3 μm in diameter. The dispersion and the salting-out agent added thereto were continuously stirred and simultaneously heated to 100° C. to effect thermal fusion of the adjacent emulsion particles for a fixed duration. The toner dispersed in water was separated by centrifugation and filtering. The separated toner was repeatedly washed with water until the pH value of the washings fell below 8 and the washed toner was dried to produce a toner having an average particle diameter of about 5 μm and a BET specific surface area of 3.18–4.50 $m^2/g$. To this toner, 0.5 parts by weight of hydrophobic silica was added as a flowability-improving agent.

The relation between the time spent for the thermal fusion and the properties of the produced toner is shown in Table 1.

The apparatuses used in examples 1 and 2 (capable of printing 20 sheets per minute) were each charged with 200 g of the toner and operated for a continuous printing test to determine the quality of print, the particle diameter distribution of the toner on the development roller, and the change in the amount of electric charging.

Even after continuous printing on 100,000 sheets of paper, the quality of print, the particle diameter distribution of the toner, and the charging properties were perfect. The toner that underwent this continuous printing was used for a continuous printing test on 20,000 sheets of paper under two sets of atmospheric conditions, 35° C. and 80% RH and 10° C. and 10% RH. The produced prints revealed neither loss of image density nor background fogging.

The test results clearly indicate that the toner enjoys an ample charging capacity, exhibits ideal flowability, and continues to produce highly durable prints of high quality when it has a particle diameter of not less than 5.0 μm and a BET specific surface area of not more than 4.50 $m^2/g$.

Examples 4–6

Minute polymer particles were prepared by following the procedure of Example 1. The polymer particles and 0.03 parts by weight of the salting-out agent added thereto were heated to 100° C. to effect thermal fusion of the adjacent particles for a fixed duration. The resultant particles were washed and dried, to afford a toner having a particle diameter about 8 μm and a BET specific surface area 2.87–3.48 $m^2/g$.

The apparatuses used in examples 1 and 2 mentioned above were each charged with 200 g of this toner and operated for a continuous printing test to determine the quality of print, the particle diameter distribution of the toner on the development roller, and the change in the amount of charging.

Even after the continuous printing performed on 100,000 sheets of paper was completed, the quality of print, the particle diameter distribution of the toner, and the charging properties were perfect.

Examples 7 and 8

Minute polymer particles were prepared by following the procedure of Example 1. The polymer particles and 0.01 parts by weight of the salting-out agent added thereto were heated to 100° C. to effect thermal fusion of the polymer particles for a fixed duration. The resultant particles were washed and dried to produce a toner having a particle diameter of about 10 μm and a BET specific surface area of 1.76–2.17 $m^2/g$.

The apparatuses used in examples 1 and 2 mentioned above were each charged with 200 g of this toner and operated for a continuous printing test to determine the quality of print, the particle diameter distribution of the toner on the development roller, and the change in the amount of charging.

Even after the continuous printing performed on 100,000 sheets of paper was completed, the quality of print, the particle diameter distribution of the toner, and the charging properties were perfect.

The test results clearly indicate that the toner offers perfect resistance to fracture and produces highly durable prints of high quality when it has a particle diameter of not more than 10.5 μm and a BET specific surface area of not less than 1.76 m/g.

Comparative Examples 1 and 2

These comparative examples represent cases in which the toners had particle diameters of not more than 5.0 μm.

Minute polymer particles were prepared by following the procedure of Example 1. The polymer particles and 0.1 parts by weight of the salting-out agent added thereto were subjected to thermal fusion for durations of two and four hours. The toners consequently obtained had an average particle diameter of about 4 μm and BET specific surface areas of 4.57–4.96 m/g.

The apparatuses used in example 1 (capable of printing 20 sheets of paper per minute) was charged with the toners and operated for a continuous printing test. In the test, the toners were deficient in flowability and in charging capacity and produced prints of unduly low image density. They also failed to impart satisfactory cleanability to the photoconductor drum.

Comparative Examples 3 and 4

These comparative examples represent cases in which the toners had BET specific surface areas of not less than 4.50 $m^2/g$.

Minute polymer particles were prepared by following the procedure of Example 1. The polymer particles and 0.05 parts by weight of the salting-out agent added thereto were subjected to thermal fusion for durations of one and two hours. The toners consequently obtained had an average particle diameter of about 5 μm and BET specific surface areas of 4.53–4.64 $m^2/g$.

The apparatus used in example 1 (capable of printing 20 sheets of paper per minute) was charged with the toners and operated for a continuous printing test to determine the quality of print, the particle diameter distribution of the toner on the development roller, and the change in charging capacity.

After the continuous printing performed on 100,000 sheets of paper was completed, the toners showed a broad particle diameter distribution, had poor flowability and an unduly low charging capacity, and produced prints lacking image density. They also failed to impart satisfactory cleanability to the photoconductor drum.

Comparative Examples 5 and 6

These comparative examples represent cases in which the toners had BET specific surface areas of not less than 4.50 $m^2/g$.

Minute polymer particles were prepared by following the procedure of Example 1. The polymer particles and 0.03 parts by weight of the salting-out agent added thereto were subjected to thermal fusion for durations of one and two hours. The toners consequently obtained had an average particle diameter of about 8 μm and BET specific surface areas of 4.52–4.57 $m^2/g$.

The apparatus used in example 1 (capable of printing 20 sheets of paper per minute) was charged with 200 g of the toners and operated for a continuous printing test.

After the continuous printing performed on 100,000 sheets of paper was completed, the toners failed to impart satisfactory cleanability to the photoconductor drum.

Comparative Example 7

This comparative example represents a case in which the toner had a BET specific surface area of not more than 1.76 $m^2/g$.

Minute polymer particles were prepared by following the procedure of Example 1. The polymer particles and 0.03 parts by weight of the salting-out agent added thereto were subjected to thermal fusion for 36 hours to produce a toner having an average particle diameter of about 8 μm and a BET specific surface area of 1.61 $m^2/g$.

In the printing test using this toner, the toner was found to impart unsatisfactory cleanability to the photoconductor drum.

Comparative Examples 8–10

These comparative examples represent cases in which the toners had particle diameters of not less than 10.5 μm.

Minute polymer particles were prepared by following the procedure of Example 1. The polymer particles and 0.01 parts by weight of the salting agent added thereto were subjected to thermal fusion for durations of two, four, and eight hours. The toners consequently obtained had an average particle diameter of about 11 μm and BET specific surface areas of 1.11–1.76 $m^2/g$.

The apparatus used in example 1 (capable of printing 20 sheets of paper per minute) was charged with 200 g of the toners and operated for a continuous printing test to determine the quality of print, the particle diameter distribution of the toner on the development roller, and the change in the charging capacity.

After the continued printing performed on 100,000 sheets of paper was completed, the toners showed a broad particle diameter distribution, had poor flowability and unsatisfactory charging capacity, and produced prints lacking in image density. They also failed to impart satisfactory cleanability to the photoconductor drum.

Comparative Example 11

This comparative example represents a case in which a metallic roller was used as the development roller.

A toner having a particle diameter 5.5 μm and a BET value of 4.29 $m^2/g$ was prepared by following the procedure of Example 1.

In the same developing apparatus as used in Example 1, except that a metallic roller was used as the development roller, the toner was tested for continuous printing ability.

After the continued printing performed on 100,000 sheets of paper was completed, the toner showed a broad particle diameter distribution, had poor flowability and unsatisfactory charging capacity, and produced prints lacking in image density. It also failed to impart satisfactory cleanability to the photoconductor drum.

Comparative Example 12

This comparative example represents a case in which a roller made of hard rubber was used as the development roller.

In the same developing apparatus as used in Comparative Example 11, except that a roller made of hard rubber was used as the development roller, a toner obtained by following the procedure of Comparative Example 11 was tested for continuous printing ability.

After the continued printing performed on 100,000 sheets of paper was completed, the toner showed a broad particle diameter distribution, betrayed poor flowability and unsatisfactory charging capacity, and produced prints lacking in image density. It also failed to impart satisfactory cleanability to the photoconductor drum.

Comparative Example 13

This comparative example represents a case in which the development roller had a hardness of not less than 50° on the Ascar scale.

In the developing apparatus identical to that used in Comparative Example 11, except that the development roller was formed of a porous electroconductive elastomer (Ascar hardness 53°), a toner prepared by following the procedure of Comparative Example 11 was tested for continuous printing ability.

After the continued printing performed on 100,000 sheets of paper was completed, the toner showed a broad particle diameter distribution, had poor flowability and unsatisfactory charging capacity, and produced prints lacking in image density. It also failed to impart satisfactory cleanability to the photoconductor drum.

The results of the examples and comparative examples cited above are collectively shown in Table 1.

TABLE 1

| | Production examples and comparative examples | | | | | | | | |
|---|---|---|---|---|---|---|---|---|---|
| | Particle diameter, μm | Thermal fusion time (hr) | BET value, $m^2/g$ | Material for development roller (Ascar C hardness) | Resistance to fracture | Charging property | | Cleaning property | |
| | | | | | | Initial | After test | (Initial) | After test |
| Production Example 1 | 5.6 | 12 | 3.18 | Polyurethane (23, 45° C.) | O | O | O | O | O |
| Production Example 2 | 5.5 | 8 | 4.29 | Polyurethane (23, 45° C.) | O | O | O | O | O |
| Production Example 3 | 5.0 | 4 | 4.50 | Polyurethane (23, 45° C.) | O | O | O | O | O |
| Production Example 4 | 8.4 | 12 | 2.87 | Polyurethane (23, 45° C.) | O | O | O | O | O |
| Production Example 5 | 8.2 | 8 | 3.19 | Polyurethane (23, 45° C.) | O | O | O | O | O |
| Production Example 6 | 8.5 | 4 | 3.48 | Polyurethane (23, 45° C.) | O | O | O | O | O |
| Production Example 7 | 10.5 | 8 | 1.76 | Polyurethane (23, 45° C.) | O | O | O | O | O |
| Production Example 8 | 10.2 | 4 | 2.17 | Polyurethane (23, 45° C.) | O | O | O | O | O |
| Comparative Example 1 | 4.7 | 4 | 4.57 | Polyurethane (23, 45° C.) | — | X | — | X | — |
| Comparative Example 2 | 4.8 | 2 | 4.96 | Polyurethane (23, 45° C.) | — | X | — | X | — |
| Comparative Example 3 | 5.6 | 2 | 4.53 | Polyurethane (23, 45° C.) | X | O | X | O | X |
| Comparative Example 4 | 5.3 | 1 | 4.64 | Polyurethane (23, 45° C.) | X | O | X | O | X |
| Comparative Example 5 | 8.3 | 2 | 4.52 | Polyurethane (23, 45° C.) | X | O | X | O | X |
| Comparative Example 6 | 8.1 | 1 | 4.57 | Polyurethane (23, 45° C.) | X | O | X | O | X |
| Comparative Example 7 | 8.8 | 36 | 1.61 | Polyurethane (23, 45° C.) | — | X | — | X | — |
| Comparative Example 8 | 11.2 | 8 | 1.11 | Polyurethane (23, 45° C.) | X | O | X | O | X |
| Comparative Example 9 | 10.8 | 4 | 1.49 | Polyurethane (23, 45° C.) | X | O | X | O | X |
| Comparative Example 10 | 11.0 | 2 | 1.79 | Polyurethane (23, 45° C.) | X | O | X | O | X |
| Comparative Example 11 | | | | Metal | X | O | X | O | X |
| Comparative Example 12 | 5.5 | 8 | 4.29 | Hard rubber | X | O | X | O | X |
| Comparative Example 13 | | | | Polyurethane (53°) | X | O | X | O | X |

In the table given above, the marks o and x stand for the following levels in the two-point scale of the relevant property indicated.

Resistance to fracture: o for absence of a discernible change in the particle quantity distribution as found by using a coaltar counter and x for a conspicuous increase in the part of particle quantity distribution having diameters of not more than 5 μm as found by the coaltar counter.

Charging property: o for a charging capacity not less than −10 μC/g and x for a charging capacity not more than −10 μC/g.

Cleanability: o for the absence of any discernible residual toner on the Photoconductor drum after passing through the cleaner unit and x for the presence of a discernible residual toner on the Photoconductor drum after passing through the cleaner unit.

Comparative Example 14

The method of this invention and the conventional method were compared by means of the following test.

The apparatus used in example 1 (capable of printing 20 sheets of paper per minute) provided with a porous electroconductive roller (Ascar hardness 28° C.) was charged with the toner (polymerization toner) obtained in Example 1 and operated for a continuous printing test to determine the change in print image density and the toner particle diameter distribution (the index for the toner's resistance to fracture).

Separately, the apparatus used in example 1 (capable of printing 20 sheets of paper per minute) provided with a hard roller (Ascar hardness 55° C.) as the development roller was charged with a pulverization toner produced by the conventional method and operated in the same manner as above.

Figure 2:
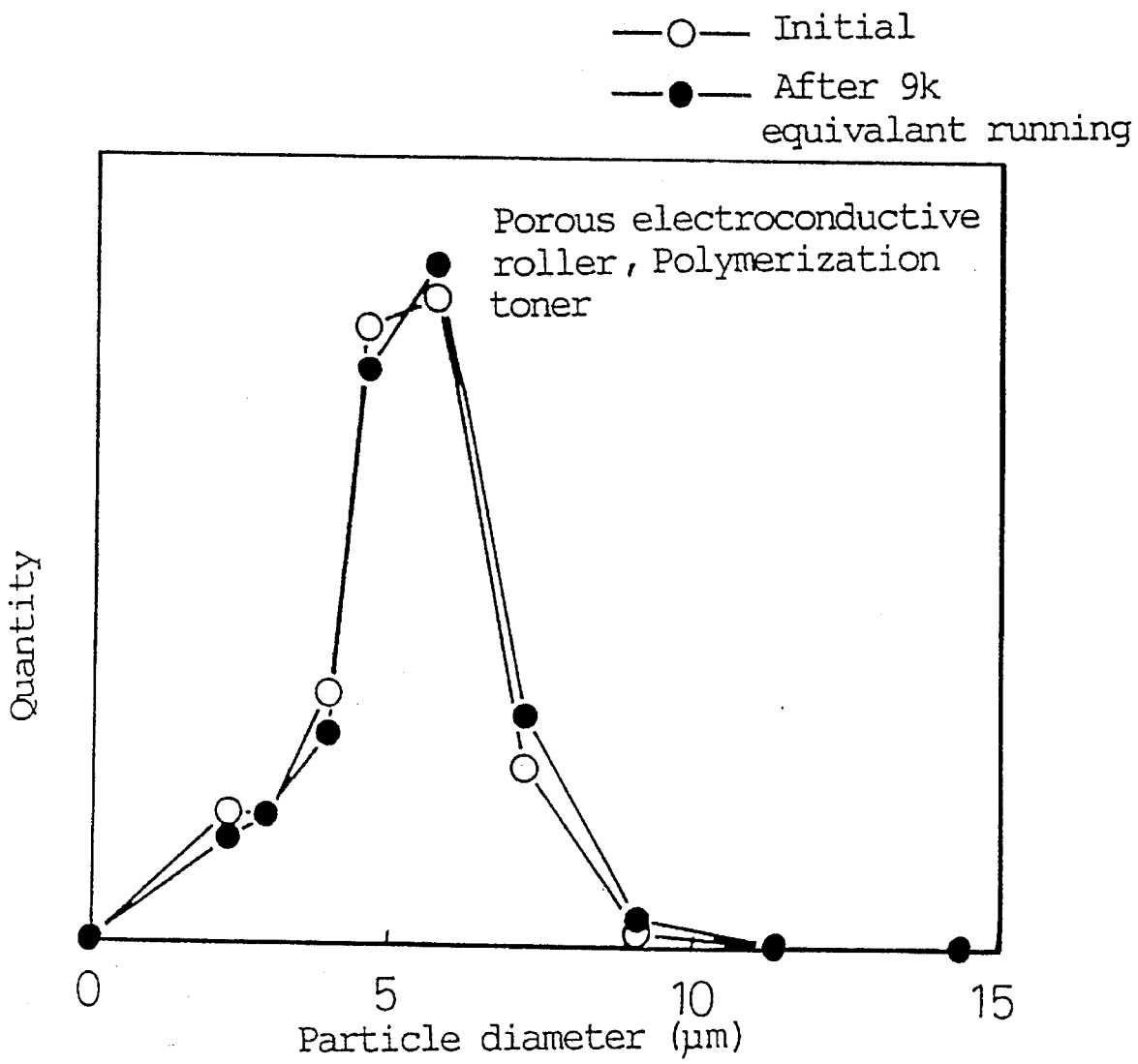
FIG. 2 is a graph showing the particle distribution of a toner for use in the method of this invention.
Figure 3:
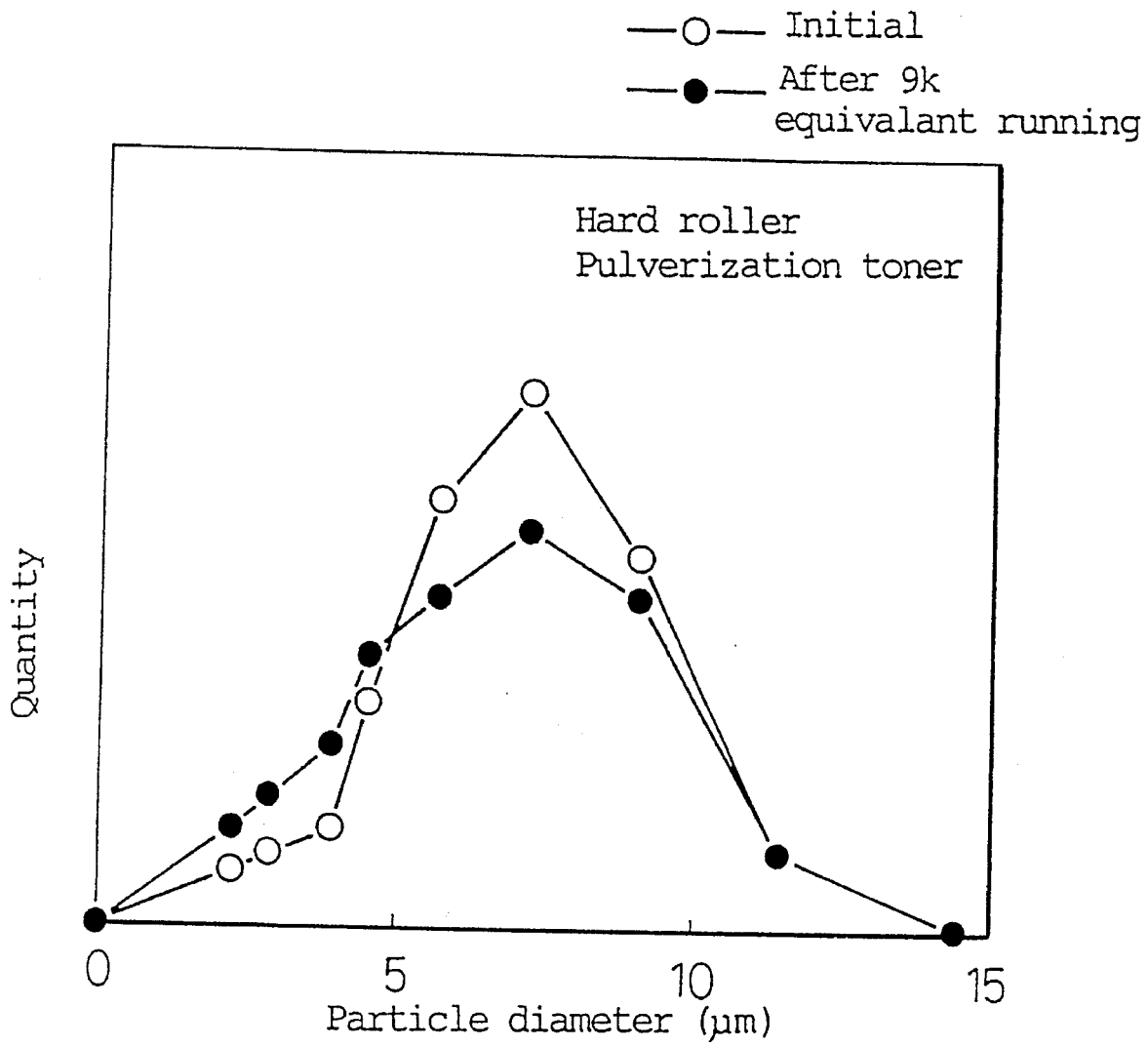
Fig. 3 PRIOR ART
FIG. 3 is a graph showing the particle distribution of the toner for use in the conventional pulverization method.

The test results are shown in Table 2 and FIGS. 2 and 3.

TABLE 2

| Change in print density | | | |
|---|---|---|---|
| | | Print density (OD value) | |
| Developing roller | Toner | Initial | After 9K equivalent running |
| Hard roller | Pulverization toner | 1.30 | 1.18 |
| Porous conductive roller | Polymerization toner | 1.42 | 1.34 |

It is clearly noted from the test results in Table 2 that the method of this invention has a smaller change in print image density than the conventional method. From FIG. 2, it is noted that the toner produced by the method of this invention excels in resistance to fracture. It is noted from FIG. 3 that the toner produced by the conventional method shows a wide particle diameter distribution and betrays deficiency in resistance to fracture.

As described above, this invention provides a method for nonmagnetic monocomponent development that excels in resistance to fracture, charging ability, and cleanability, and produces highly durable prints of high quality. Thus, this invention finds extensive utility in the development of images in various copying machines and printers.

We claim:

1. A method for nonmagnetic monocomponent development, comprising the steps of:

(a) forming a nonmagnetic toner as a developer, the toner having a BET specific surface area of not more than 4.50 $m^2/g$, the toner being formed by the substeps comprising:

forming minute particles by emulsion polymerizing a radically polymerizable monomer in an aqueous type solvent in the presence of a water-soluble initiator;

coagulating the minute particles; and heating the coagulated minute particles and thermally fusing adjacent coagulated minute particles;

(b) allowing the developer to be transported by a developer carrier to a latent image carrier; and (c) causing a layer thickness-regulating member to supply an electric charge to the developer while regulating the thickness of a layer of the developer.

2. A method according to claim 1, wherein said developer carrier is formed of a soft electroconductive elastomer.

3. A method according to claim 1, wherein said developer carrier has a hardness of not more than 50° on the Ascar C scale.

4. A method according to claim 1, wherein said developer carrier has a porous texture.

5. A method according to claim 1, wherein said developer carrier has pores not more than 20 μm in diameter.

6. A method according to claim 1, wherein said developer carrier has a volume intrinsic resistance between $10^4$ and $10^{10}$ Ωcm.

7. A method for nonmagnetic monocomponent development according to claim 1, wherein the toner has an average particle diameter between 5.0 and 10.5 μm.

8. A method for nonmagnetic monocomponent development according to claim 1, wherein the toner has a BET specific surface area of not less than 1.76 $m^2/g$.

9. A method for nonmagnetic monocomponent development according to claim 1, wherein the minute particles formed by emulsion polymerization have average diameters between 0.1 and 3.0 μm before the minute particles are coagulated.

10. A method of forming a nonmagnetic toner, comprising the steps of:

(a) forming minute particles by emulsion polymerizing a radically polymerizable monomer in an aqueous type solvent in the presence of a water soluble initiator;

(b) coagulating the minute particles; and (c) heating the coagulated minute particles and thermally fusing adjacent coagulated minute particles to derive nonmagnetic polymer particles having a BET specific surface area of not more than 4.50 $m^2/g$.

11. A method of forming a nonmagnetic toner according to claim 10, wherein the radically polymerizable monomer is selected from the group consisting of styrene-acryl, styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-nonylstyrene, p-n-octylstyrene, p-n-hexylstyrene, p-n-dodecylstyrene, an ethylenically unsaturated monoolefin, a halogenated vinyl, an α-methylene fatty acid monocarboxylate, a vinyl ether, a vinyl ketone, an n-vinyl compound, a vinyl naphthalene, acrylic acid, methacrylic acid, acrylonitrile, methacrylonitrile, and acrylamide.

12. A method of forming a nonmagnetic toner according to claim 10, wherein step (a) includes the substep of adding between 0.01 and 1% by weight, based on an amount of water, of an emulsifier.

13. A method of forming a nonmagnetic toner according to claim 10, wherein step (a) includes the substep of adding between 0.01 and 10% by weight, based on an amount of polymer mixture, of a polymerization initiator.

14. A method of forming a nonmagnetic toner according to claim 10, wherein the toner has an average particle diameter between 5.0 and 10.5 μm.

15. A method of forming a nonmagnetic toner according to claim 10, wherein the toner has a BET specific surface area of not less than 1.76 $m^2/g$.

16. A method of forming a nonmagnetic toner according to claim 10, wherein the minute particles formed by emulsion polymerization have average diameters between 0.1 and 3.0 μm before the minute particles are coagulated.

17. A nonmagnetic toner comprising:

nonmagnetic polymer particles formed from a monomer of a hydrocarbon having an ethylenically unsaturated bond, the polymer particles being substantially devoid of sharp corners, having an irregular shape and having a BET specific surface area of not more than 4.50 $m^2/g$; and pigment.

18. A nonmagnetic toner according to claim 17, wherein the hydrocarbon having an ethylenically unsaturated bond is selected from the group consisting of styrene-acryl, styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-nonylstyrene, p-n-octylstyrene, p-n-hexylstyrene, p-n-dodecylstyrene, an ethylenically unsaturated monoolefin, a halogenated vinyl, an α-methylene fatty acid monocarboxylate, a vinyl ether, a vinyl ketone, an n-vinyl compound, a vinyl naphthalene, acrylic acid, methacrylic acid, acrylonitrile, methacrylonitrile, and acrylamide.

19. A nonmagnetic toner according to claim 17, wherein the toner has an average particle diameter between 5.0 and 10.5 μm.

20. A nonmagnetic toner according to claim 17, wherein the toner has a BET specific surface area of not less than 1.76 $m^2/g$.

21. A printing system comprising:

a nonmagnetic developer comprising:

nonmagnetic polymer particles formed from a monomer of a hydrocarbon having an ethylenically unsaturated bond, the polymer particles being substantially devoid of sharp comers, having an irregular shape and having a BET specific surface area of not more than 4.50 $m^2/g$, and pigment;

a latent image carrier;

developer carrier means for transporting the developer to the latent image carrier; and layer thickness-regulating means for supplying an electric charge to the developer while regulating the thickness of a layer of the developer.

22. A printing system according to claim 21, wherein the developer carrier means is formed of a soft electroconductive elastomer.

23. A printing system according to claim 21, wherein the developer carrier means has a hardness of not more than 50° on the Ascar C scale.

24. A printing system according to claim 21, wherein the developer carrier means has a porous texture.

25. A printing system according to claim 21, wherein the developer carrier means has pores not more than 20 μm in diameter.

26. A printing system according to claim 21, wherein the developer carrier means has a volume intrinsic resistance between $10^4$ and $10^{10}$ Ωcm.

* * * * *